US007843335B2

(12) United States Patent
Furey et al.

(10) Patent No.: US 7,843,335 B2
(45) Date of Patent: Nov. 30, 2010

(54) MOBILE ASSET TRACKING UNIT, SYSTEM AND METHOD

(75) Inventors: Daniel Furey, Sterling, VA (US); Louis F. Wise, Oak Hill, VA (US)

(73) Assignee: Blackbird Technologies, Inc., Herndon, VA (US)

( * ) Notice: Subject to any disclaimer, the term of this patent is extended or adjusted under 35 U.S.C. 154(b) by 867 days.

(21) Appl. No.: 11/717,575

(22) Filed: Mar. 13, 2007

(65) Prior Publication Data

US 2008/0224854 A1 Sep. 18, 2008

(51) Int. Cl.
*G08B 1/08* (2006.01)

(52) U.S. Cl. ..... 340/539.13; 340/286.01; 340/540

(58) Field of Classification Search ..... 340/539.13, 340/286.01, 540
See application file for complete search history.

(56) References Cited

U.S. PATENT DOCUMENTS 5,841,396 A * 11/1998 Krasner ..... 342/357.02
5,867,481 A 2/1999 Miyagi
5,875,181 A * 2/1999 Hsu et al. ..... 370/320
5,940,379 A * 8/1999 Startup et al. ..... 370/320
6,215,498 B1 4/2001 Filo et al.
6,222,483 B1 * 4/2001 Twitchell et al. ..... 342/357.09
6,327,533 B1 * 12/2001 Chou ..... 340/988
6,615,253 B1 * 9/2003 Bowman-Amuah ..... 709/219
6,804,602 B2 10/2004 Impson et al.
6,810,293 B1 10/2004 Chou et al.
6,859,831 B1 2/2005 Gelvin et al.
6,998,985 B2 2/2006 Reisman et al.
7,034,678 B2 4/2006 Burkley et al.
7,065,446 B2 6/2006 Chou
7,072,668 B2 * 7/2006 Chou ..... 455/456.1
7,080,322 B2 7/2006 Abbott et al.
7,113,864 B2 9/2006 Smith et al.
7,155,335 B2 * 12/2006 Rennels ..... 340/907
7,245,216 B2 7/2007 Burkley et al.
7,535,417 B2 * 5/2009 Atkinson ..... 342/357.12
7,750,801 B2 7/2010 Culpepper et al.
7,783,304 B2 * 8/2010 Himmelstein ..... 455/456.1
2002/0097181 A1 * 7/2002 Chou et al. ..... 342/357.06
2002/0169539 A1 11/2002 Menard et al.
2003/0043761 A1 * 3/2003 Hladik ..... 370/319
2004/0196182 A1 * 10/2004 Unnold ..... 342/357.07

(Continued)

OTHER PUBLICATIONS

Office Action mailed Aug. 24, 2010 for U.S. Appl. No. 11/894,835, filed Aug. 21, 2007.

*Primary Examiner*—Eric M Blount

(57) ABSTRACT

An asset tracking unit, system, and method. The asset tracking unit, system, and method may include at least one transceiver having communicative connections with at least one SATCOM network and at least one GPS network via at least one antenna, wherein tracking information for at least one asset associated with the at least one transceiver is received from the GPS network and is communicated to the SATCOM network, a first link that provides a multi-code one of the communicative connections between the at least one transceiver and the at least one SATCOM network, and a second link that provides a multi-channel one of the communicative connections between the at least one transceiver and the at least one GPS network. The unit system and method may additionally include at least one remote operations center remote from an asset to be tracked, wherein the asset to be tracked is geographically associated with the central processing unit.

52 Claims, 5 Drawing Sheets

U.S. PATENT DOCUMENTS

2006/0007038 A1* 1/2006 Boling et al. ..... 342/357.1
2006/0202817 A1* 9/2006 Mackenzie et al. ..... 340/539.13
2006/0234693 A1 10/2006 Isidore et al.
2006/0252999 A1 11/2006 Devaul et al.
2010/0075643 A1 3/2010 Cooper et al.

* cited by examiner

Antenna Radiation Pattern

MOBILE ASSET TRACKING UNIT, SYSTEM AND METHOD

BACKGROUND OF THE INVENTION

1. Field of the Invention

The present invention is directed generally to mobile electronics and communications, and, more specifically, to a mobile asset tracking unit and system.

2. Description of the Background

There is an absence in the currently available technological arts of a single device, system and method that allows for the tracking and locating of assets, in the form of persons or equipment, "in the field" during the presence of those assets in remote or inaccessible locations, wherein that single device, system and method presents extended usage time and efficient information transfer. For example, entities operating in wartime, or other dangerous environments, first responder circumstances, or remote recreational activities such as hiking and climbing, do not presently have access to a methodology whereby such entities can be efficiently tracked and/or transfer respective status, without need to carry extra batteries or have access to a remote power source. Further, available technologies do not safeguard such entities from communications theft, communications breakdown, information theft, or poor communications reception. Further, such entities presently are not tracked in view of other such entities or relative to other important assets.

Rather, entities are presently not tracked, or are not tracked in view of other assets, or are not tracked in conjunction with information regarding the asset that is vital to survival of the asset, or are asked to carry a myriad of items to account for contingencies, such as carrying extra batteries in case a loss of power occurs, or are not able to be tracked as they navigate in ill-defined geographic regions or in regions having poor communications reception. Such lack of knowledge, lack of information, and need to carry extra items may prove very undesirable and highly disadvantageous, particularly to entities acting in wartime, hostile environments, or as first responders.

Thus, a need exists for a mobile, handheld device, system, and method that efficiently, with high information flow, and with low power consumption, securely tracks assets in one or more fields of use.

BRIEF SUMMARY OF THE INVENTION

The present invention includes an asset tracking unit, system, and method. The asset tracking unit, system, and method may include at least one transceiver having communicative connections with at least one SATCOM network and at least one GPS network via at least one antenna, wherein tracking information for at least one asset associated with the at least one transceiver is received from the GPS network and is communicated to the SATCOM network, a first link that provides a multi-code one of the communicative connections between the at least one transceiver and the at least one SATCOM network, and a second link that provides a multi-channel one of the communicative connections between the at least one transceiver and the at least one GPS network.

The asset tracking unit for use with the unit, system, and method may be of handheld size. The transceiver may include a multi-code, such as 14-20 codes, SATCOM transceiver and a multi-channel, such as a 16 channel, GPS transceiver. The antenna may be an active quadrifilar helix GPS antenna. The transceiver may operate for only non-continuous operation periods.

The asset tracking unit, system, and method may additionally include at least one status indicator operably connected to the at least one transceiver, wherein said at least one status indicator indicates a status of the connection of the at least one transceiver to at least one of the SATCOM network and the GPS network. The unit, system, and method may additionally include at least one mode switch that, when activated, changes an at least one mode of the at least one transceiver.

In certain embodiments, the unit, system, and method of the present invention may also include, within the unit, a data encoder that encrypts information transmitted by the at least one transceiver via the at least one SATCOM network. The data encoder may be associated with a central processing unit that controls the at least one transceiver.

The unit system and method may additionally include at least one remote operations center remote from an asset to be tracked, wherein the asset to be tracked is geographically associated with the central processing unit. The at least one remote operations center may communicate with multiple ones of the at least one central processing unit via the SATCOM network. This communication may additionally pass though numerous ground-based transceivers and the Internet. The at least one remote operations center may be and include a messaging hub and command relay for at least two of the central processing units associated with different ones of the assets.

The remote operations center may be a tiered architecture, and may be password accessible only by the at least one central processing unit, and all communications to and from the remote operations center may be encrypted.

Thus, the present invention provides a mobile, handheld device, system, and method that efficiently, with high information flow, and with low power consumption, tracks assets in one or more fields of use.

BRIEF DESCRIPTION OF THE SEVERAL VIEWS OF THE DRAWINGS

For the present invention to be clearly understood and readily practiced, the present invention will be described in conjunction with the following figures, wherein like reference numerals represent like elements, and wherein.

DETAILED DESCRIPTION OF THE INVENTION

It is to be understood that the figures and descriptions of the present invention have been simplified to illustrate elements that are relevant for a clear understanding of the present invention, while eliminating, for purposes of clarity, many other elements found in typical tracking and communications systems, devices and methods. Those of ordinary skill in the art will recognize that other elements are desirable and/or required in order to implement the present invention. However, because such elements are well known in the art, and because they do not facilitate a better understanding of the present invention, a discussion of such elements is not provided herein.

Figure 1:
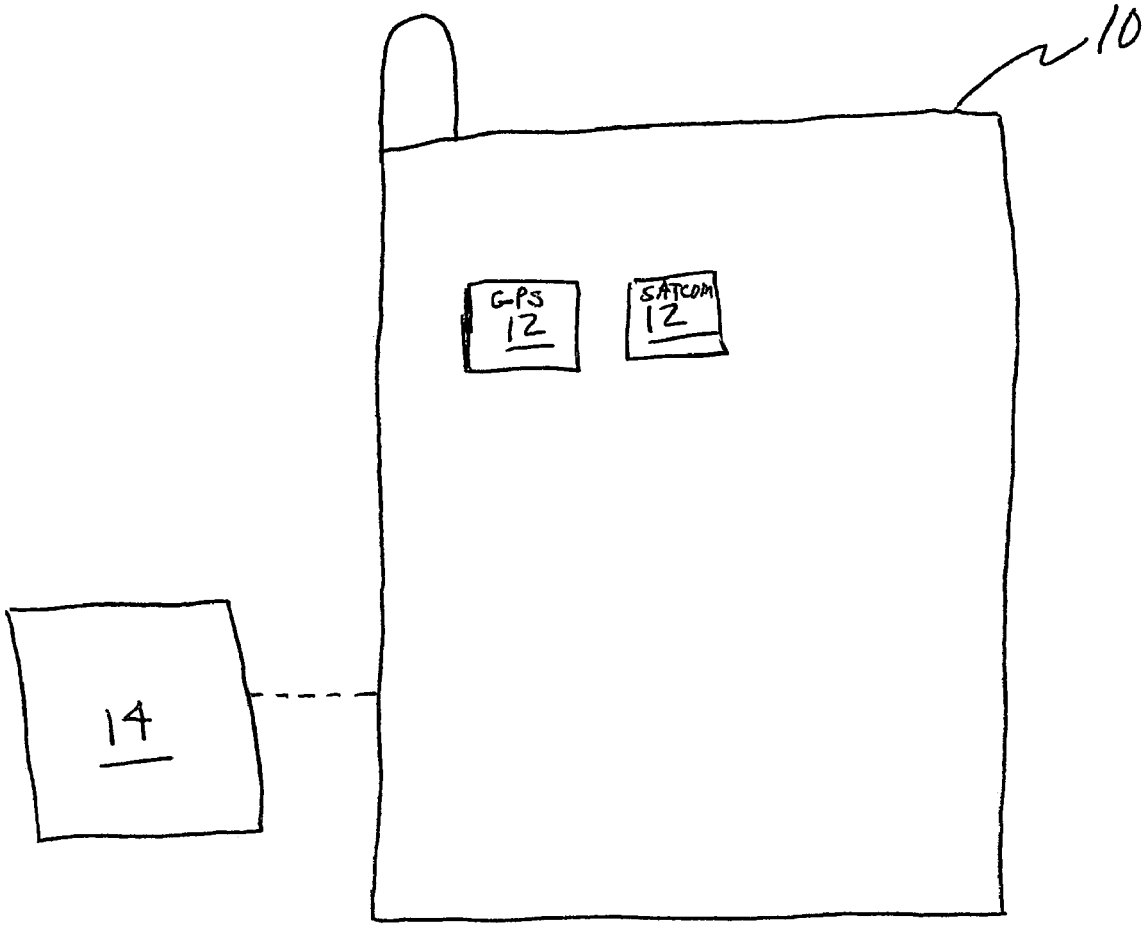
FIG. 1 is a functional block diagram illustrating an asset tracking unit in accordance with the present invention.

An exemplary asset tracking unit (unit) 10 operating within the system and method of the present invention is illustrated in the functional block diagram of FIG. 1. The unit of the present invention is and includes one or more transceiver units 12. The unit(s) may be dedicated to the tracking of assets 14. Assets, as used herein, include persons, mobile and stationary equipment, vehicles and other means of transportation whether by ground, air, water, or otherwise, UAV's and other aerospace—related assets, other communications devices, and the like.

In order to allow for carrying of the unit by assets in the form of persons, the unit may be sized such that the unit may be handheld. Of course, as will be apparent to those skilled in the art, the unit may be efficiently sized larger than handheld size for uses associated with non-person, such as large equipment, assets. For example, the size of such a handheld unit may be, for example, about 2-4 inches in width, about 4-7 inches in height, and about 0.5-3 inches in depth. Those skilled in the art will well understand that similar size ranges to those stated hereinabove may be employed to enable the holding of the unit in the hand of a user, and that larger size ranges may be employed in the event there is not a need to have the unit be small, whether it be held in the hand of the user or otherwise. Additionally or alternatively, the unit may have associated therewith any one or more of a known myriad of mounting or holding capabilities, such as straps, handles, knobs, velcro, magnets, glue or epoxy, including re-usable adhesives, and the like.

Figure 2:
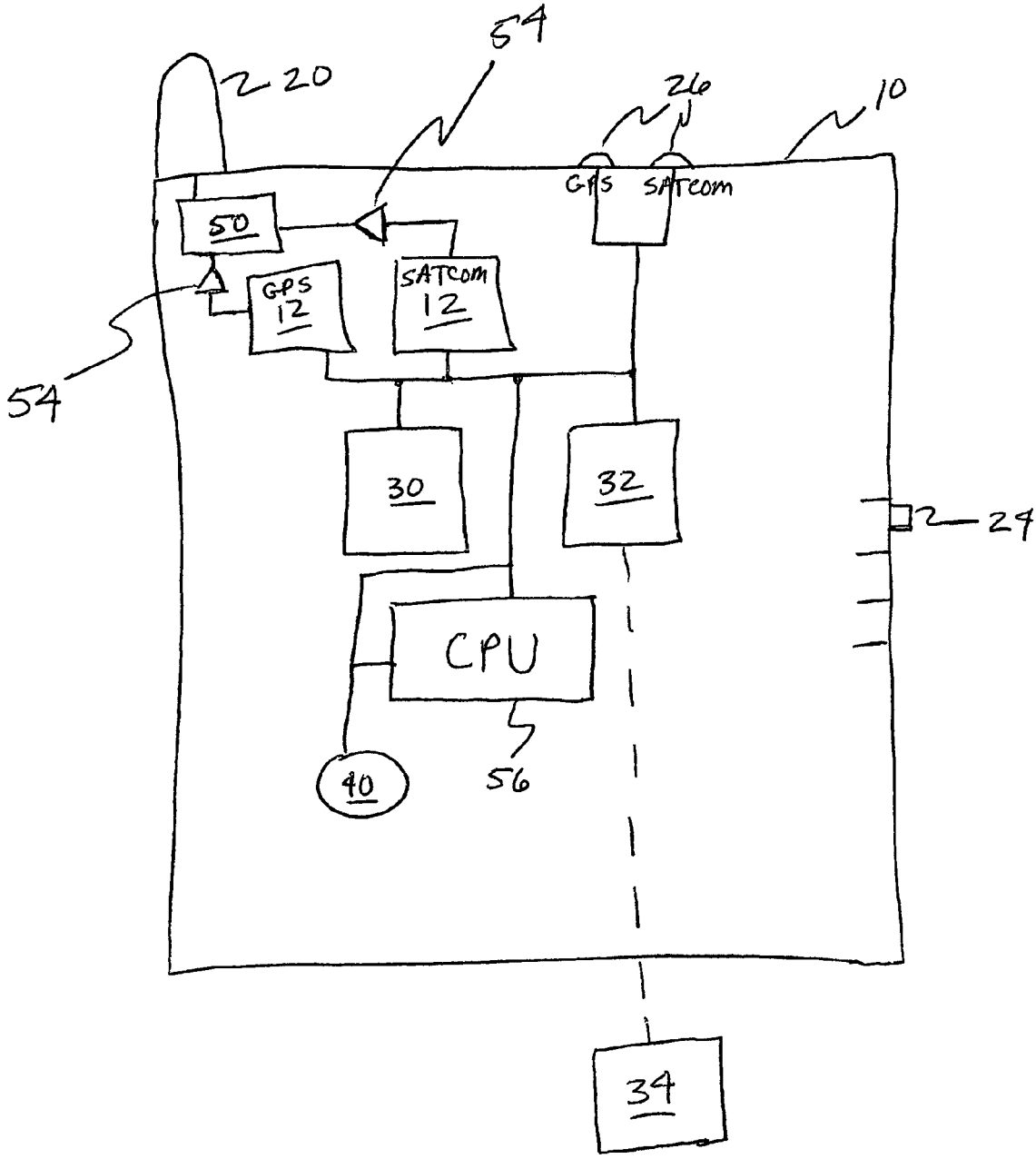
FIG. 2 is a functional block diagram illustrating an asset tracking unit in accordance with the present invention.

The unit may have associated therewith one or more features to allow for advantageous use of the unit, as illustrated in FIG. 2. For example, the unit may include one or more features for use in conjunction with low power consumption, and may include a receiver 12 equipped for satellite communication. Alternatively, receiver 12 may also be a transceiver, to provide greater functionality. As used herein, any receiver as described in any particular embodiment of the present invention may also be a transceiver. The unit may further have the same or a different transceiver or receiver 12 equipped for global positioning system (GPS) communication, which satellite transmissions may be multi-code and which GPS transmissions may be multichannel, such as 16 channel GPS, an active antenna, such as an active quadrifilar helix GPS antenna 20, multiple receiver or transceiver mode switches 24, which may include at least one non-continuous transmission mode, GPS and/or SATCOM communication status indicators 26, a data encoder 30 to enable encryption of information transmitted, environmental robustness features, and connectivity to an asset tracker network via a remote operations center(s).

In order to improve hardware extensibility, the unit may optionally include standard computer interoperability features, such as USB interfaces, card-based secure digital storage, external hard drive capability, and antenna, ethernet, modem, or firewire communication plug-ins, for example.

Further, as illustrated in FIG. 2, the unit may advantageously include a capability to monitor the status of the asset being tracked 32. The status of the asset may be independently monitored by the unit, or may be monitored by a separate electronic device 34 used in conjunction with the unit. Such a separate electronic device may preferably be in electronic communication with the asset tracking unit, such as by the computer interoperability features discussed hereinabove, such as via wired, RF, or infrared communication. Such monitoring of asset status may include, for example, monitoring of environmental conditions, vital signs, weights, electronic signature, or the like. As such, electronic devices in communication with the asset tracking unit may include vital sign monitors, pressure transducers, RF IDs, damage sensors, humidity sensors, radioactivity sensors, heat sensors, and the like, for example.

Additionally with regard to the exemplary embodiment illustrated in FIG. 2, the asset tracking transmitter of the present invention may allow for the transceiver to be in communication with a satellite network, such as the GlobalStar satellite constellation, via satellite communication (SATCOM) transmissions. In certain embodiments of the present invention, the SATCOM communication may be one way, i.e., the satellite communication may occur only from the handheld unit to a satellite. Of course, in other embodiments, the unit may be capable of two way SATCOM transmission, that is, transmission and reception of satellite communications.

Further with regard to SATCOM transmission by the unit, multiple codes may be included via the transceiver in the satellite transmission. For example, between 14 and 20 total codes may be transmitted in the satellite transmission, and these codes may include, for example, one of many, such as fourteen; different transmit codes, the current GPS position of the handheld unit, the unit identification code of the handheld unit, and a time-stamp of the subject transmission. The codes may include codes indicating information relevant to the asset being tracked, such as the status of the asset as discussed hereinabove.

As will be apparent to those skilled in the art, the GPS position transmitted via SATCOM may be obtained by the unit from the GPS receiver within the unit. The subject GPS receiver may be, for example, a sixteen channel GPS receiver. The GPS signal may be received via any antenna known to those skilled in the art, but most preferably via an active antenna, such as the aforementioned active quadrifilar helix GPS antenna.

The asset tracker unit of the present invention may be used in any one of a number of different activities or environments, including, but not limited to, child safety, remote outdoor activities such as hiking and climbing, emergency first response, and blue force/red force tracking (National Security-related), as well as tracking vehicles and other means of transportation, whether by ground, air, water, or otherwise, UAV's and other aerospace vehicles. In certain of the these embodiments, most particularly those related to national defense or security, all data transmitted by the handheld unit may be encrypted by the data encoder for increased security, such as by using advanced encryption standard (AES)-128, and/or the RSA asymmetric encryption algorithm, and/or the like, for example. Of course, those skilled in the art will understand that other encryption methodologies may be used, and other methodologies for increasing data security may be employed, such as staggered communication techniques or data scrambling. For example, the unit may make use of spread spectrum transmissions, such as 0.25 watt spread spectrum transmissions with 2.5 megahertz frequency bands as discussed further hereinbelow.

Figure 3:
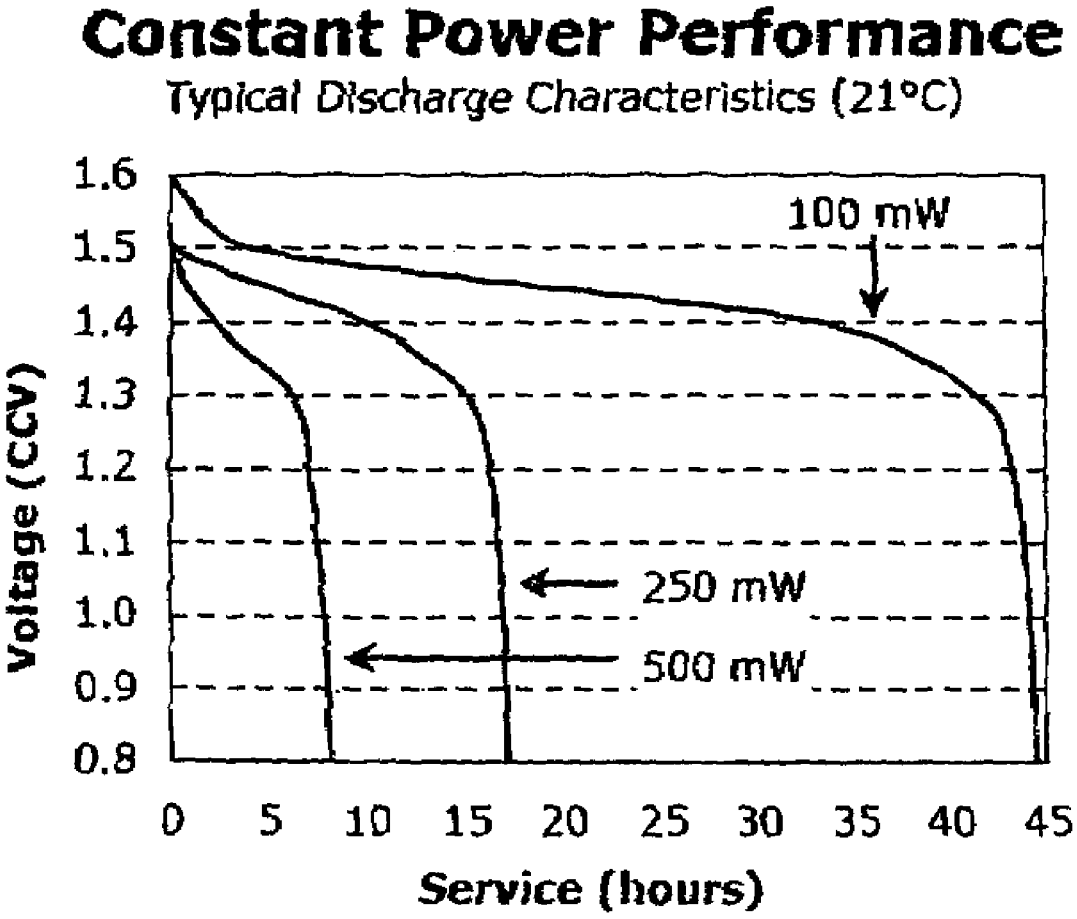
FIG. 3 is a graphical depiction of the in-service time of an asset tracking unit in accordance with the present invention.

Due to the use in the environments discussed hereinabove, in which certain environments largely preclude the transport of battery packs or the availability of additional batteries or external power sources, the handheld unit of the present invention may employ one or more techniques for significant power savings over similar units available in the prior art. The unit of the present invention may run on small, lightweight batteries, such as, for example, as few as two 1.5V AA lithium batteries, or other chemical types of small batteries. Of course, other battery types 40 may be employed, as may be other power sources. For example, in suitable environments, the unit may run on external power, or allow for recharging of batteries via external power, or may run on solar power, for example. In order to provide robustness of the unit during periods of variable power availability, a handheld one of the units may operate acceptably in an operating range of 1.8-3.3 V DC. The operating time of the unit may be a function of the environment of operation, the available power supply, and the power consumption normalized to a constant power consumption. In the exemplary embodiment discussed hereinabove wherein two AA lithium batteries are employed in the unit, FIG. 3 illustrates the service time, in hours, of the unit at numerous constant power consumptions in a constant 21 degree Celsius environment. Of course, other operating ranges for voltage of the unit may be available, particularly in the event the asset tracker unit is not of handheld size, and the handheld unit may have an operating voltage outside the aforementioned range in the circumstance wherein certain of the characteristics of the unit discussed hereinthroughout are modified.

In order to provide power savings, and thereby maximize battery life in battery-operated embodiments, the handheld unit may engage in SATCOM transmissions, or GPS receptions, in non-continuous time frames 50. For example, for SATCOM transmissions, the unit may transmit the aforementioned codes only at predetermined intervals, or may transmit only partial information packets at certain intervals (i.e., the unit may transmit only position and unit identification at certain times), and full information packets (i.e. packets containing the full complement of SATCOM codes) at other intervals. Alternatively, the unit may identify instances of poor communication, and may skip attempts at communication during intervals in which transmissions are unlikely to be received by the intended recipient. Likewise, the unit may attempt receipt of GPS location signals only during periods in which it can be verified that the GPS satellite constellation is "in view."

Non-continuous communication time frames for communication may be modified by a user of the handheld unit, or at an operations center as discussed further hereinbelow. Such non-continuous communication time frames may appreciably prolong operation times on a single set of batteries. For example, if the device of the present invention is used primarily for GPS tracking, and the SATCOM transmission mode is used non-continuously and relatively infrequently, the device may run constantly for more than approximately fifteen hours on just a single set of the above-referenced AA lithium batteries. Further, either the user of the handheld device or the operations center may configure the unit to make the most efficient use of RF frequencies for communications to avoid consumption of excess battery power. For example, the user or the operations center may be enabled to vary the RF frequency among at least four channels of operations via mode switching, using the aforementioned resolution of 2.5 MHz per operating mode frequency band. Such operating modes may be identified using channel identifiers for ease of use by the user, such as by indicating on the unit channels A, B, C, or D, or channels 1, 2, 3, or 4, or any similar methodology of channel indication.

The present invention may also include an accelerometer, or motion sensor. To conserve power and battery life, the unit may optionally not transmit unless it has subsequently moved to a different location. For example, when the unit is relatively still, it may automatically turn off the GPS. Subsequently, after the unit moves or has moved a certain amount, the accelerometer/motion sensor function may turn on or otherwise activate the GPS.

As discussed hereinabove, the performance of the handheld unit of the present invention must be acceptable in any of a variety of environments. As such, the unit performs acceptably after exposure to temperatures between 60 degrees C. and −20 degrees C., and may perform acceptably at even greater temperature ranges. Further, the unit operates properly after exposure to extreme humidity levels, and may be modified to be made waterproof. For example, the casing of the unit may be waterproofed, such as being hermetically sealed, or the internal elements used within the device may be waterproofed. Additionally, the unit may perform properly after exposure to any of a variety of vibrations, such as random vibrations from 20 Hz to 2000 Hz, and to 0.04 GHz. Finally, the unit may preferably operate after being subjected to high salt conditions, such as a salt fog, and/or may operate properly after being subjected to any of a number of chemicals, such as those that might be employed in a chemical warfare attack. Further, the SATCOM, GPS, and communication capabilities of the subject device must comply with appropriate regulations, and specifically environmental and operational regulations, and exhibit proper performance characteristics with regard to radiated emissions, radiated immunity, conducted emissions, conducted immunities, and electrostatic discharges, for all operating environments.

Figure 4:
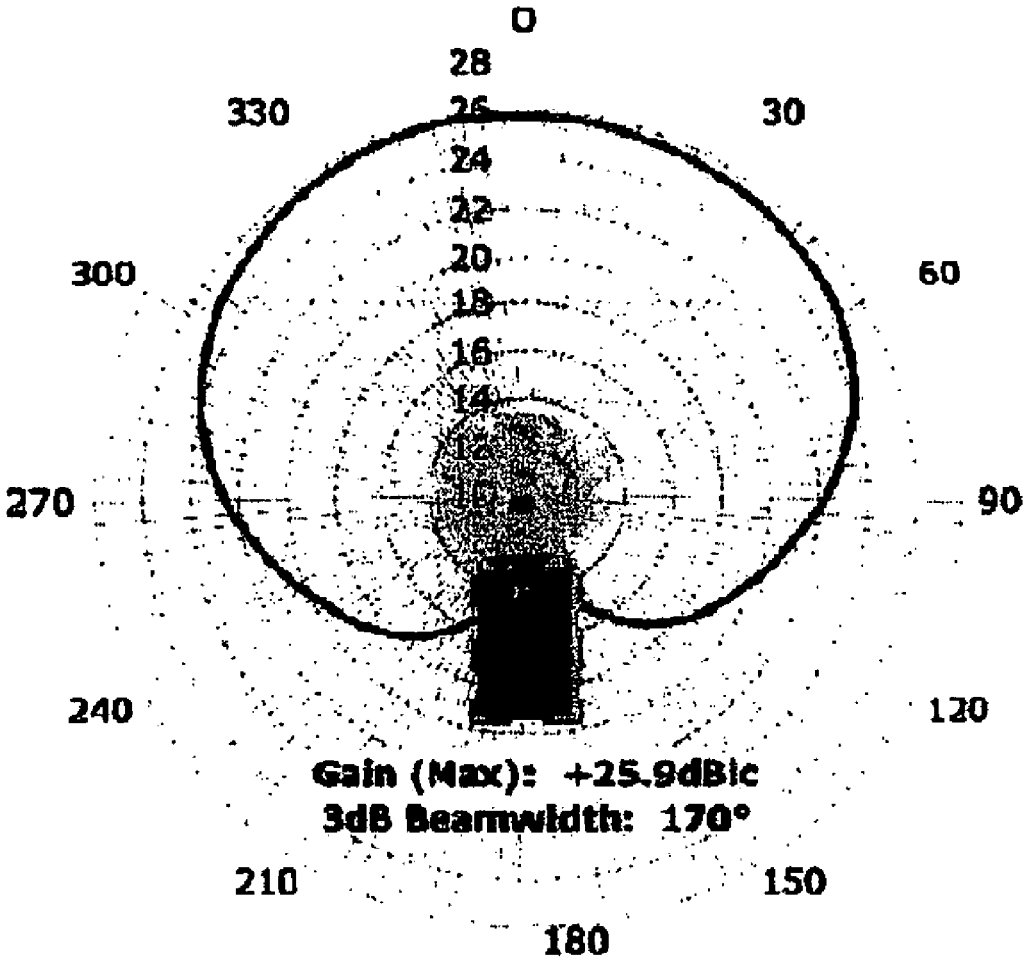
FIG. 4 is a graphical depiction of a radiation pattern of an exemplary antenna for use with the present invention.

The radio communications engaged in by the unit of the present invention occur via one or more antenna(e) 20 contained within the unit. The at least one antenna is operably connected to each of the SATCOM and the GPS transceiver (s) discussed hereinabove. For example, the GPS receiver or transceiver of the present invention may communicate with the GPS satellite constellation via a an active antenna having an operating frequency of, for example, 1575.42 MHz+/−2 MHz, such as the aforementioned active quadrifilar helix GPS antenna capable of 16-channel GPS reception. For example, a GeoHelix-S antenna may be employed in the unit, and the radiation pattern of this exemplary antenna embodiment is illustrated in FIG. 4. Further, ease of use of the instant invention as a handheld unit may be aided by employing the GPS antenna as an embedded antenna, although those skilled in the art will recognize that the antenna may be at least partially externally mounted.

In a preferred embodiment, the GPS antenna of the present invention may deliver stable performance in all use modes and use environments, including environments with high free space or high lossy dielectric content, to enable use of the present device in a myriad of harsh environments, densely populated environments, or densely forrested environments in which typical GPS devices exhibit poor performance. Of course, in the operating environments discussed hereinthroughout, and particularly in defense-related application environments, such as in international locations, communication by the antennae employed in the present invention with the desired satellites may be difficult but may be of the utmost importance. This may, of course, be accomplished in part through the use of antennae having high acceptance angles. Correspondingly, as mentioned with respect to FIG. 2, the status of accessibility to the desired communication system may be made evident on the unit, such as by communication status indicators 26 for at least one SATCOM network and the GPS network. When the desired network(s) are accessible to the antenna(e) of the handheld unit, these indicators may indicate as such, such as by a constant or flashing light associated with a labeled network indicator (i.e. a label indicating "GPS" or "SATCOM", for example).

The SATCOM transceiver of the instant invention may employ any satellite antenna known to those skilled in the art that is capable of communication with the desired satellite system used with the unit of the present invention. Additionally, the same antenna as that used for the GPS antenna may be modified such that the antenna is capable of periodically switching from the GPS mode of operation, having a center frequency of 1575.42 MHz, for example, to SATCOM communication mode.

Of course, the antennae associated with the asset tracking unit of the present invention may have associated therewith one or more amplifiers 54 in order to amplify transceived signals. For example, the GPS antenna discussed hereinabove may have integrated therewith a low noise amplifier (LNA).

As discussed hereinabove, the receiver(s) or transceiver(s) of the unit may include or be accessible to one or more encoders for data encryption, particularly for data encryption associated with high security environments of operation. The unit may encrypt sent data, and decrypt received data, pursuant to any encryption algorithm known to those skilled in the art. For example, the unit may operate using an AES-128 encryption algorithm, which may operate in satisfaction of the NIST Known Answer test.

Each of the encoder(s), transceiver(s), modes, and communication status indicators of the unit may be operably connected to one or more central processing unit(s) (CPUs) 56 that operate the asset tracking unit. The CPU may operate each of the modules associated with the unit, at the proper time and pursuant to the proper information. The CPU may additionally interface to one or more operating systems. Such operating systems may follow user commands, such as to switch modes of communication, may display to a user, such as via indicator lights or a video display, the status of connections to desired networks, may modify or allow modification of non-continuous communication timing on any available network, and may perform other similar functions. The CPU may actively interface with the one or more hardware elements associated with the hardware and functionality of the unit as described herein. Further, the CPU may send or receive information, such as within the codes sent via SATCOM communications, that allows for or indicates certain actions have, or are to, occur within the asset tracking unit.

Further, as discussed hereinabove, the CPU may interoperate with indicators or a display that indicate information to the user of the asset tracking unit, and the CPU may use the information sent via the SATCOM codes to communicate with one or more operations centers to indicate information to the interested user(s) at the operations center(s). For example, a user of the unit may receive, and be able to view via an optional display as controlled by the CPU, status not only of that user's unit, but also of other users/units. Further, a user at the operations center may be able to view certain statuses, and locations, of multiple units then in operation, at one or at multiple locations.

Figure 5:
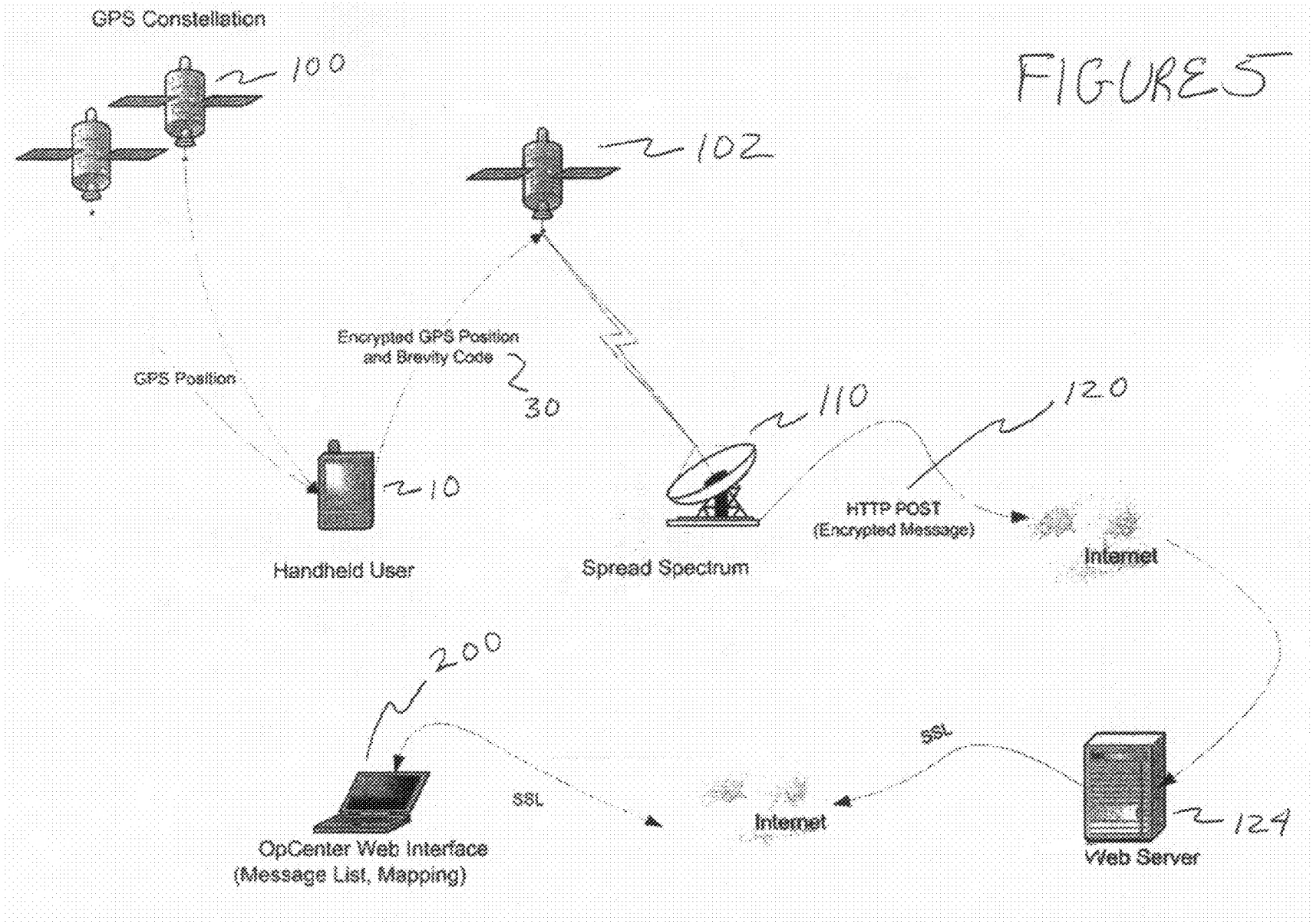
FIG. 5 is a functional block diagram illustrating an asset tracking system in accordance with the present invention.

In an exemplary embodiment of the present invention illustrated in FIG. 5, in which the unit 10 is resident in a system of like-users communicatively connected to one or more operations center(s), the asset tracking unit may communicate with a GPS constellation 100, and one or more SATCOM networks 102, as discussed hereinthroughout. As illustrated, the unit may use encrypted communication 30, such as on the transmission to the one or more SATCOM network(s). The unit may also engage in data compression, or decompression of compressed data, for increased efficiency of communication 30.

As illustrated in FIG. 5, following receipt (or sending) by the desired SATCOM satellite, the information received (or sent) may be indicated, such as by spread spectrum communication techniques, to one or more ground-based transceivers 110. Such ground-based transceivers may communicate 120, preferably via secure, encrypted communications, with one or more Web-based servers 124, such as via the Internet, an Intranet, or a dedicated communication network line, for example. Such Web-based server(s) may preferably be in communication with one or more operations centers 200, as discussed hereinabove.

The operations center(s) of the present invention may provide messaging capabilities to or from the one or more asset tracking units in the field, and/or may provide a command "push" capability to remotely control the one or more units, or their respective modes of operations or operating systems. Additionally, the operations center(s) may provide a hub through which units in the field can communicate with one another, such as by sending a message to the operations center, and indicating in the message that the message is then to be sent by the operations center back through the network to a different one of the units in the field. This dynamic relaying of information may, for increased data security, be directed from all devices only to and from the operations center(s), wherein the operations center(s) alone then makes available such data to authorized units also connected to the operations center(s), or, alternatively, information may be shared directly between multiple ones of the units as well as with the operations center(s), such as via the SATCOM network.

The required computational capabilities of the unit, and hence the power consumed by the unit, may be minimized by the coordinating of operations of one or more of the units by the at least partial "thin client" operation discussed hereinabove, in which the remote operations center(s), via the one or more central Web servers, bears the burden of a significant portion of the computational aspects of the unit(s). For example, each unit in a system of orchestrated units may be coordinated through, instructed by, monitored by, and/or reported on by one or more of the remote operations centers, wherein each such operations center may provide a graphical user interface that maps the one or more units in the field, via one or several map displays indicating the location and/or status of each unit in the field, and that generally allows interested operations center users to manage the assets associated with remotely located ones of the units.

More specifically with regard to the exemplary operations center implementation of the present invention, the operations center may feature a tiered architecture for both security and scalability. Thereby, a single operations center deployment may support hundreds or thousands of units simultaneously. Access to the remote operations center may be role based, with password protected messaging and encrypted communication as discussed hereinthroughout, and may employ the multi-code communications over the SATCOM network.

Such roles, current status, and current data may lend themselves to application at the operations center(s) of one or more databases, such as relational databases. Such database or databases may conveniently track, within the tiered system, all information required by the operations center(s) to efficiently task and monitor large numbers of units, and may discreetly make available to ones of the mobile units such information as is required by only the authorized ones of the units attempting to access the operations center(s). Further, in addition to relaying messages and relating tracking information, the one or more operations center(s) may incorporate a cryptographically authenticated, remote command framework(s) that allows the operations center(s), if authenticated, to remotely manipulate one or more of the units.

Those of ordinary skill in the art will recognize that many modifications and variations of the present invention may be implemented. The foregoing description is intended to cover all such modifications and variations, and the equivalents thereof.

What we claim is:

1. An asset tracking unit, comprising:

at least one transceiver in communication with at least one SATCOM network and at least one GPS network via at least one antenna, tracking information for at least one asset associated with the at least one transceiver configured to be received from the GPS network and communicated to the SATCOM network;

a first link configured to provide a multi-code connection between said at least one transceiver and the at least one SATCOM network;

a second link configured to provide a multi-channel connection between said at least one transceiver and the at least one GPS network; and an accelerometer configured to activate or deactivate at least one of said multi-code connection or said multi-channel connection.

2. The asset tracking unit of claim 1, wherein the at least one asset is one of a person, a mobile equipment, a vehicle or a communications device.

3. The asset tracking unit of claim 1, wherein the asset tracking unit is between a range of about 2-4 inches in width, about 4-7 inches in height, and about 0.5-3 inches in depth.

4. An asset tracker, comprising:

a multi-code SATCOM transceiver having at least 16 codes;

a multi-channel GPS transceiver;

at least one antenna electrically connected to each of said multi-code SATCOM transceiver and said multi-channel GPS transceiver; and a non-continuous operation controller for said SATCOM transceiver, said non-continuous operation controller allows operation of said SATCOM transceiver for only non-continuous operation periods.

5. The asset tracker of claim 4, wherein said multi-channel GPS transceiver includes a 16 channel GPS transceiver.

6. The asset tracker of claim 4, wherein said at least one antenna includes an active quadrifilar helix GPS antenna.

7. An asset tracking unit, comprising:

at least one transceiver in connection with at least one SATCOM network and at least one GPS network;

at least one status indicator operably coupled to said at least one transceiver, wherein said at least one status indicator indicates a status of the connection of said at least one transceiver to at least one of the SATCOM network and the GPS network;

at least one mode switch that, when activated, changes a mode of said at least one transceiver; and at least one antenna electrically coupled to said at least one transceiver.

8. The asset tracking unit of claim 7, wherein the mode is a non-continuous transmission mode for said at least one transceiver.

9. The asset tracking unit of claim 7, wherein said at least one transceiver is physically associated with at least one asset to be tracked, the asset tracking unit further comprising:

a data encoder that encrypts information transmitted by said at least one transceiver via the at least one SATCOM network.

10. The asset tracking unit of claim 9, further comprising a central processing unit that is configured to control said at least one transceiver.

11. The asset tracking unit of claim 10, further comprising an external connection to said central processing unit including one of a USB interface, a card-based secure digital storage, an external hard drive, an ethernet jack, a modem jack, or a firewire connection.

12. The asset tracking unit of claim 10, further comprising a separate electronic device in operative communication with said central processing unit, wherein the status of the handheld asset tracking unit is monitored by said separate electronic device and is communicated to said central processing unit.

13. The asset tracking unit of claim 12, wherein the separate electronic device is operatively coupled to the central processing unit using one of a wire, an RF link, or an infrared link.

14. The asset tracking unit of claim 12, wherein the status is indicative of at least one of environmental conditions, vital signs, weight, or electronic signature.

15. The asset tracking unit of claim 12, wherein the separate electronic device includes at least one of a vital sign monitor, a pressure transducer, an RF ID, a damage sensor, a humidity sensor, or a heat sensor.

16. The asset tracking unit of claim 9, wherein the connection between said at least one transceiver and the SATCOM network is a multi-code connection having a plurality of codes.

17. The asset tracking unit of claim 16, wherein the plurality of codes includes between 14 and 20 codes.

18. The handheld asset tracking unit of claim 17, wherein the plurality of codes includes at least a plurality of transmit codes, a GPS location, and an identification of the handheld asset tracking unit.

19. The asset tracking unit of claim 18, wherein the plurality of transmit codes include at least one status code indicative of the health of the at least one asset.

20. The asset tracking unit of claim 9, wherein the connection between said at least one transceiver and the GPS network is a multi-channel connection.

21. The asset tracking unit of claim 9, wherein said at least one antenna includes a quadrifilar helix GPS antenna.

22. The asset tracking unit of claim 9, wherein said data encoder employs AES-128 encoding.

23. The asset tracking unit of claim 9, further comprising at least one power supply operably coupled to said at least one transceiver.

24. The asset tracking unit of claim 23, wherein said at least one power supply supplies power for a non-continuous operation of said at least one transceiver for at least 14 hours.

25. The asset tracking unit of claim 24, wherein the at least one transceiver operates at predetermined intervals during the non-continuous operation.

26. The asset tracking unit of claim 24, wherein the at least one transceiver operates during the non-continuous operation only when communication with at least one of the GPS network and the SATCOM network is of high-quality.

27. The asset tracking unit of claim 26, further comprising a contingency position locator operable when communication with the GPS network is of low-quality.

28. The asset tracking unit of claim 24, wherein the non-continuous operation is modifiable by a local user.

29. The asset tracking unit of claim 24, wherein the non-continuous operation is modifiable by a remote user in communication with said at least one transceiver via the SATCOM network.

30. The asset tracking unit of claim 9, further comprising at least one mode switch configured to switch the at least one transceiver between at least two modes.

31. The asset tracking unit of claim 30, wherein the at least two modes include modes in which the transceiver is configured to operate at 1611.25, 1613.75, 1616.25, and 1618.75 MHz.

32. The asset tracking unit of claim 9, wherein said at least one transceiver is operable after exposure at temperatures between 60 degrees C. and −20 degrees C.

33. The asset tracking unit of claim 9, further comprising a housing, said at least one transceiver, said at least on status indicator, and said at least one data encoder being physically within said housing, said housing being waterproofed.

34. The asset tracking unit of claim 33, wherein said housing is hermetically sealed.

35. The asset tracking unit of claim 9, wherein said at least one antenna has a high acceptance angle.

36. The asset tracking unit of claim 9, further comprising at least one central processing unit configured to control said at least one transceiver, said at least one status indicator, and said at least one data encoder.

37. The asset tracking unit of claim 36, further comprising a video display operably coupled to said at least one central processing unit, said video display configured to display information related to the handheld asset tracking unit such that the information is viewable by a local user.

38. An asset tracking system, comprising:

a central processing unit configured to control at least one transceiver, said at least one transceiver configured to receive a location position for the central processing unit from a multi-channel GPS network, said at least one transceiver configured to communicate with at least one multi-code SATCOM network as directed by said central processing unit; and at least one remote operations center remote from an asset to be tracked, the asset to be tracked being geographically associated with said central processing unit, said at least one remote operations center being configured to communicate with multiple central processing units via the SATCOM network, said at least one remote operations center including a tiered architecture, all communication to and from said at least one remote operations center being encrypted.

39. The asset tracking system of claim 38, wherein said central processing unit is configured to communicate with said at least one operations center using compressed data.

40. The asset tracking system of claim 38, further comprising a plurality of ground-based transceivers configured to securely relay communications from at least one communications network to said at least one remote operations center.

41. The asset tracking system of claim 40, wherein said at least one communications network includes the Internet.

42. The asset tracking system of claim 38, wherein the central processing unit is a first central processing unit from a plurality of central processing units, said at least one remote operations center including a messaging hub for receiving messages from at least two central processing units from the plurality of central processing units associated with distinct assets.

43. The asset tracking system of claim 42, wherein said messaging hub includes a command relay for remotely controlling the at least two central processing units.

44. The asset tracking system of claim 42, wherein said messaging hub includes a message relay configured to relay messages between the at least two central processing units.

45. The asset tracking system of claim 38, wherein said at least one remote operations center includes a remote manager for central processing unit.

46. A processor-readable medium storing code representing instructions to cause a processor to:

receive a first plurality of signals from a plurality of asset tracking units indicating a position of each asset tracking unit from the plurality of asset tracking units via a multi-code SATCOM network;

display the position of each asset tracking unit from the plurality of asset tracking units on a display as indicated by a multi-channel GPS signal received at each asset tracking unit from the plurality of asset tracking units;

receive a second plurality of signals from the plurality of asset tracking units indicating a status of each asset from a plurality of assets, each asset from the plurality of assets being collocated with an asset tracking unit from the plurality of asset tracking units;

display the status of each asset from the plurality of assets on the display;

receive a third signal from a first asset tracking unit from the plurality of asset tracking units, the third signal associated with a message intended to be received by a second asset tracking unit from the plurality of asset tracking units; and send a fourth signal to the second asset tracking unit containing the message.

47. The processor-readable medium of claim 46, the code further comprising code representing instructions to cause a processor to:

remotely manipulate a third asset tracking unit from the plurality of asset tracking units in response to receiving the second plurality of signals.

48. The processor-readable medium of claim 46, wherein the status of each asset from the plurality of assets includes at least one of an indication of environmental conditions surrounding each asset, an indication of vital signs of each asset, or an indication of a weight of each asset.

49. The processor-readable medium of claim 46, the code further comprising code representing instructions to cause a processor to:

authenticate the second asset tracking unit prior to sending the fourth signal.

50. The processor-readable medium of claim 46, the code further comprising code representing instructions to cause a processor to:

send a fifth signal associated with the position of each asset tracking unit from the plurality of asset tracking units to a subset of the plurality of asset tracking units.

51. The processor-readable medium of claim 46, wherein the first plurality of signals and the second plurality of signals are received via a SATCOM network.

52. The processor-readable medium of claim 46, the code representing instructions to cause a processor to display the position of each asset tracking unit representing instructions to cause a processor to display the position of each asset tracking unit from the plurality of asset tracking units in response to verifying a role of a first user, the code further comprising code representing instructions to cause a processor to:

display the position of each asset tracking unit from a subset of the plurality of asset tracking units on the display in response to verifying a role of a second user.

* * * * *